United States Patent [19]

Cannon

[11] 4,018,131

[45] Apr. 19, 1977

[54] ELECTRONIC METRONOME

[76] Inventor: Robert L. Cannon, 17 Lakeview Terrace, Waltham, Mass. 02154

[22] Filed: May 27, 1975

[21] Appl. No.: 581,132

[52] U.S. Cl. ..... 84/484; 58/130 E; 340/384 E

[51] Int. Cl.[2] ..... G04F 5/02; G08B 3/10

[58] Field of Search ..... 84/1.01, 1.03, 484, 84/DIG. 12; 58/130 R, 130 A, 130 C, 130 E; 340/384 E

[56] References Cited

UNITED STATES PATENTS

| | | | |
|---|---|---|---|
| 2,926,347 | 2/1960 | Thiele | 84/484 UX |
| 3,038,120 | 6/1962 | Bernstein et al. | 58/130 E UX |
| 3,271,670 | 9/1966 | Esakov et al. | 84/484 X |
| 3,320,608 | 5/1967 | Pande et al. | 58/130 R X |
| 3,341,840 | 9/1967 | Berkheiser | 58/130 E UX |
| 3,467,959 | 9/1969 | Zazofsky | 84/484 X |
| 3,534,649 | 10/1970 | Andersson | 84/484 |
| 3,540,344 | 11/1970 | Veech | 84/484 |
| 3,691,896 | 9/1972 | Allesio | 84/484 |
| 3,818,693 | 6/1974 | Allard | 58/130 E |
| 3,901,121 | 8/1975 | Klener | 84/484 |

*Primary Examiner*—Stanley J. Witkowski
*Attorney, Agent, or Firm*—Weingarten, Maxham & Schurgin

[57] ABSTRACT

An electronic metronome capable of providing subdivisions and cross rhythms in an audibly distinct manner. The metronome is comprised of solid state circitry including a linear potentiometer in a compensating network to yield an intended non-linear metronome characteristic, and can be readily contained in a small pocket size package including a battery source and loudspeaker.

9 Claims, 5 Drawing Figures

ELECTRONIC METRONOME

FIELD OF THE INVENTION

This invention relates to metronomes and more particularly to an electronic metronome circuit providing selectable tempi according to the Maelzel metronome characteristic.

BACKGROUND OF THE INVENTION

Pendulum type mechanical metronomes are classically known in the art in which selection of a tempo is provided by adjustment of a weight along the pendulum rod of a clock movement. Successive selectable tempi within the metronome range are characterized by an essentially logarithmic calibration function with standard calibration points being known as Maelzel markings. According to such marking scheme, a tempo is variable by approximately $1/\sqrt{X}$ where X is the amount of adjustment between tempi markings. At slower tempi there is relative wide spacing between successive markings, while as the tempo increases, the spacing becomes correspondingly less as a natural result of the logarithmic characteristic. Electronic metronomes are also known for providing tempo indications by use of an electronic oscillator which drives a loudspeaker or other output indicator. Accurate calibration of known electronic metronomes is difficult because of the need to use a potentiometer with a logarithmic resistance characteristic. Such potentiometers have tolerances larger than the desired accuracy of the metronome. If a linear potentiometer is substituted in these circuits, the resolution at low rates is inadequate.

SUMMARY OF THE INVENTION

According to the invention, an electronic metronome is provided which is adjustable within a manually selectable continuous range with relatively simple circuitry and additionally capable of providing subdivisions and cross rhythms in an audibly distinct manner. The novel metronome includes as a manual control of tempo a standard linear potentiometer employed in a compensating network to yield the intended non-linear metronome characteristic which is traditional and desirable for metronomes. The novel metronome is preferably constructed of solid state circuitry and can be contained in a small size package readily carried in a shirt or coat pocket and operable with a small battery source. Audible beat indications are provided by a loudspeaker contained within the metronome housing, the resonant characteristics of the speaker being matched to that of the housing to provide efficient energy transfer for highly effective speaker energization. The speaker is energized by relatively short duration pulses from the novel circuit to produce audible beats, while pulses of different duration are provided to the speaker for providing audibly distinct sub-beats.

DESCRIPTION OF THE DRAWING

The invention will be more fully understood by reference to the following detailed description taken in conjunction with the accompanying drawing in which.

DETAILED DESCRIPTION OF THE INVENTION

Figure 1:
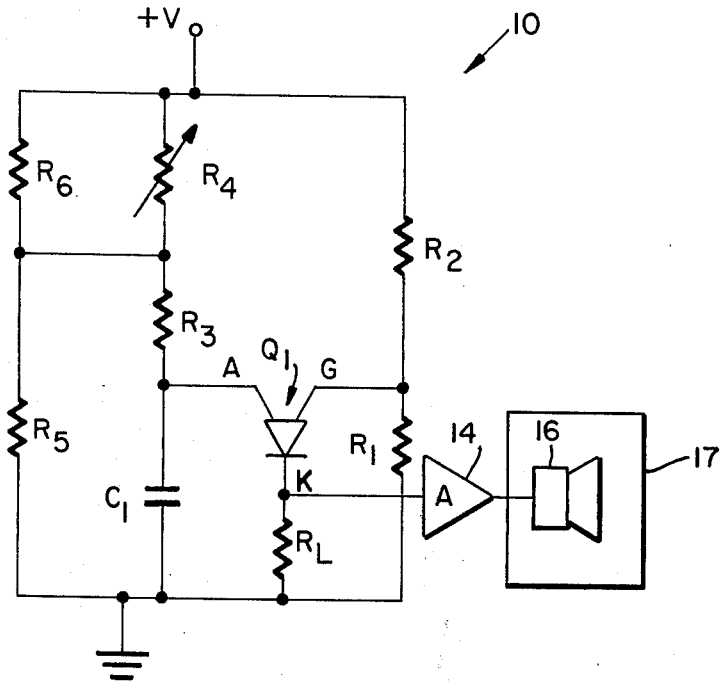
FIG. 1 is a schematic diagram of an electronic metronome according to the invention.

Referring to FIG. 1 there is shown an electronic metronome circuit 10 having a manually adjustable linear potentiometer $R_4$ for selection of intended tempi. The output of the circuit is taken across a load resistor $R_L$ and provided to an amplifier 14 and thence to an output device, usually a loudspeaker 16 contained within a resonant enclosure 17. A PNPN-type semiconductor device $Q_1$, such as a programmable unijunction transistor (PUT), has a cathode terminal K coupled to amplifier 14, a gate terminal G coupled to load resistors $R_1$ and $R_2$ which are coupled respectively to ground and to a DC voltage source +V, and an anode terminal A coupled to charging capacitor $C_1$ and to a fixed resistor $R_3$. Charging capacitor C is coupled to ground, and resistor $R_3$ is coupled in series with potentiometer $R_4$, which, in turn, is coupled to voltage source +V. A resistor $R_5$ is coupled from the junction of potentiometer $R_4$ and resistor $R_3$ to ground, while a resistor $R_6$ is coupled across potentiometer $R_4$. Resistor $R_6$ is of a large value with respect to that of the other resistive elements for reasons to be explained hereinafter.

Metronome circuit 10 operates as a relaxation oscillator wherein the rate of oscillation is controllable according to a predetermined non-linear characteristic. The output of the amplifier is driven to saturation at each beat so as to cause a short duration pulse in substantial resonance with the output device. A resonant pulse gives rise to a characteristic beat having the greatest acoustic output. The values for the resistors $R_1$, $R_2$ and $R_L$ determine the specific operating parameters of the active device $Q_1$. Resistors $R_3$, $R_5$, and $R_6$ form a compensation network for linear potentiometer $R_4$ to provide a non-linear sequence of tempo calibrations according to Maelzel markings. The rate of oscillation is dictated by the choice of the components $C_1$, $R_3$, $R_4$, $R_5$ and $R_6$ forming a resistive-capacitive (RC) timing circuit. The ratio of the values of resistors $R_5$ to $R_6$ is determinative of the amount of non-linearity of tempo adjustment in the RC timing circuit. Resistor $R_6$ is selected to be large with respect to the other resistors in the timing circuit in order that a linear adjustment of potentiometer $R_4$ for a selected set of active device parameters and selected value for resistor $R_3$ provides the desired Maelzel calibration. The load resistor $R_5$ is relatively non-critical to the non-linear adjustment characteristic. It is operative to set the low limit of oscillation rate. Resistor $R_3$, however, directly limits the charging rate of the storage capacitor $C_1$ and therefore controls the high rate limit of adjustment. The oscillation rate may be selected to be variable over the normal metronome range of 40–206 beats/min., or over a higher harmonic range, as where the resultant output is to represent subdivisions of beats. Generally, however, the range of adjustment does not exceed six octaves.

Figure 2:
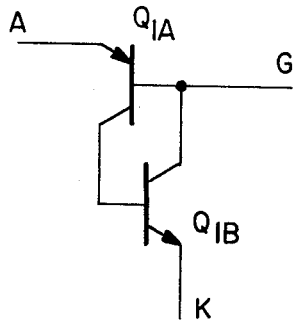
FIG. 2 is a schematic diagram of a double transistor configuration useful in the invention.

Other active devices may be substituted for the PNPN device $Q_1$ shown in FIG. 1. Referring to FIG. 2 there is shown, for example, the combination of PNP-type transistor $Q_{1A}$ and an NPN-type transistor $Q_{1B}$, together forming the functional equivalent of $Q_1$. The emitter of transistor $Q_{1A}$ and the collector of transistor $Q_{1B}$ are coupled together to be operative as the gate G, and the emitter of transistor $Q_{1B}$ is operative as the cathode K.

Figure 3:
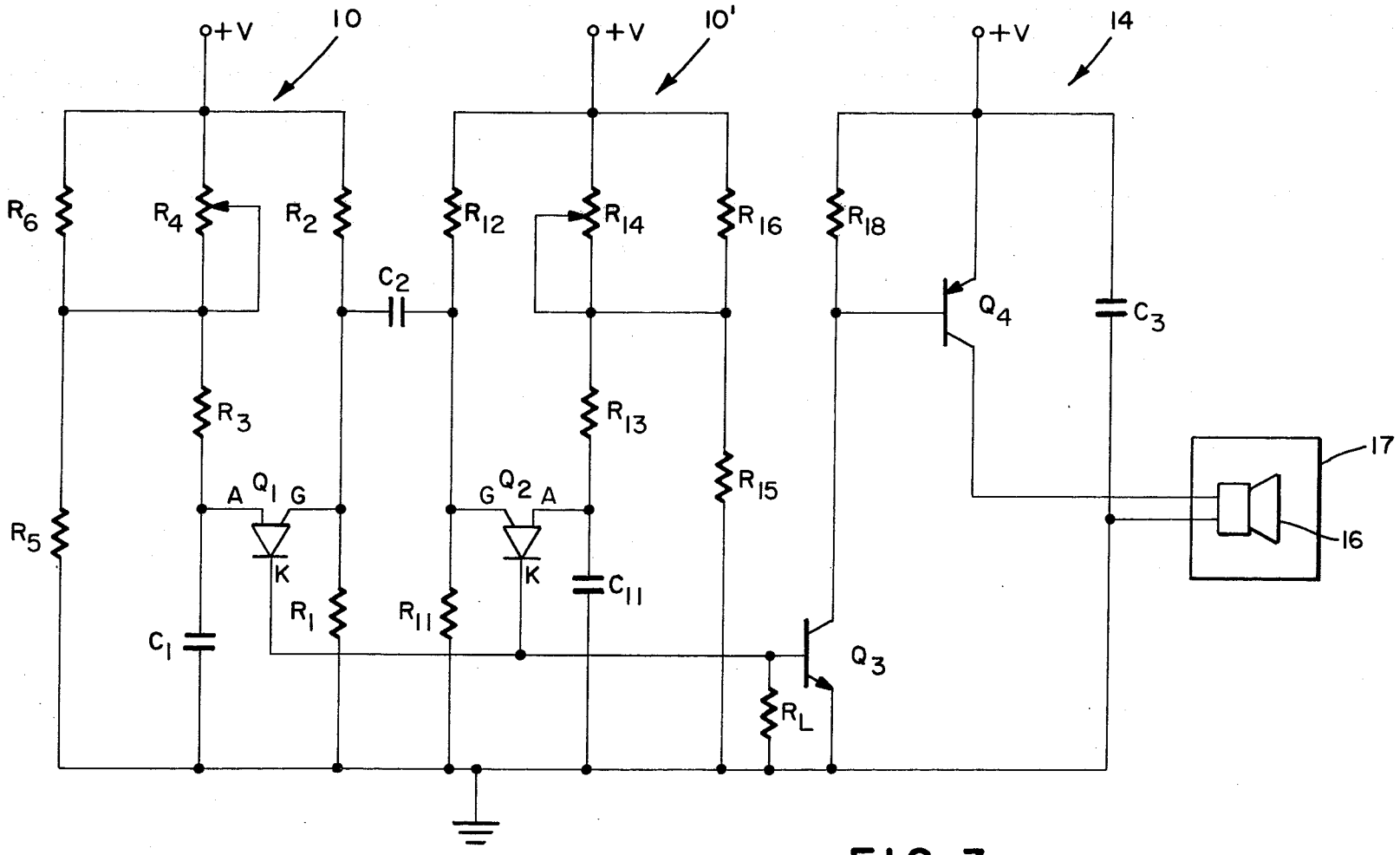
FIG. 3 is a schematic diagram of an alternative embodiment of the invention.

Referring to FIG. 3 there is shown an embodiment of the invention in which two metronome circuit portions 10 and 10', each of which is the operational equivalent of metronome circuit 10 of FIG. 1, are coupled together in a manner providing synchronous independently adjustable cross rhythms. A small capacitor $C_2$ loosely couples the gate of active device $Q_1$ to the gate of a similar active device $Q_2$. The outputs of the two circuit portions derived at the cathode terminals of devices $Q_1$ and $Q_2$ are coupled to a common output amplifier in which includes an NPN switching transistor $Q_3$ driving a PNP switching transistor $Q_4$, which in turn drives loudspeaker 16 mounted in resonant enclosure 17.

Circuit portion 10' produces a short-duration pulse at the beginning of each beat which differs in duration from the short pulse produced by circuit 10. One of the pulse outputs is operative to resonantly drive loudspeaker 16 in its enclosure 17, while the other of the pulse outputs does not resonantly drive the loudspeaker. As a result, the acoustic output of the loudspeaker is distinctive to each of the circuit portions 10 and 10'. Audibly distinct beats can thereby be provided. For example, pulses from circuit portion 10' having a pulse width half that of the pulses from circuit portion 10 will cause a beat having a magnitude and timbre audibly different from the level and timbre of a beat produced by circuit portion 10.

The coupling capacitor $C_2$ is operative to couple sufficient energy between the circuit portions 10 and 10' to ensure that circuit portions 10 and 10' operate synchronously. Linearly variable potentiometers $R_4$ and $R_{14}$ provide through substantially evenly spaced angular settings independent non-linear adjustments over the desired range of combinations of cross rhythms.

In a preferred embodiment of the novel metronome circuit of FIG. 3, the following components and values can be employed:

| | |
|---|---|
| $Q_1$ and $Q_2$ | 2N6028 |
| $Q_3$ | 2N4400 |
| $Q_4$ | 2N4402 |
| $R_1$ and $R_{11}$ | 4.3 K ohms |
| $R_2$ and $R_{12}$ | 13 K ohms |
| $R_L$ | 82 K ohms |
| $R_4$ and $R_{14}$ | 100 K ohms |
| $R_3$ and $R_{13}$ | 270 K ohms |
| $R_5$ and $R_{15}$ | 56 K ohms |
| $R_6$ and $R_{16}$ | 2.4 M ohms |
| $R_{18}$ | 13 K ohms |
| $C_1$ | 3.9 $\mu$f |
| $C_{11}$ | 1.8 $\mu$f |
| $C_2$ | 0.001 $\mu$f |
| $C_3$ | 100 $\mu$f |

Figure 4:
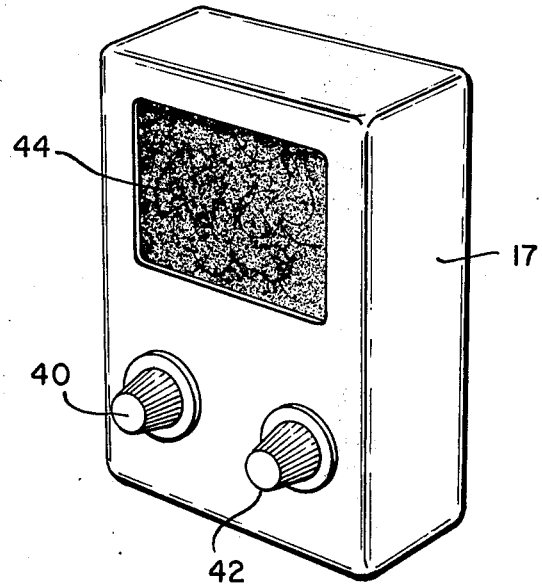
FIG. 4 is a pictorial view of a metronome in typical packaged configuration.

The invention can be fabricated in extremely small size by use of the solid state circuitry described and is typically packaged in a small, readily portable device such as shown in FIG. 4, of a size easily carried in a shirt pocket. The metronome includes control knobs 40 and 42 for manual selection of tempo and subrhythm, respectively. The loudspeaker is contained behind a speaker grill 44 provided in enclosure 17. As discussed, the speaker is preferably resonantly coupled to its enclosure and resonantly driven by one of the series of energizing pulses, typically the pulses for the selected prime tempo, such that relatively high acoustic efficiency is achieved for the production of readily discernible audible beats.

Figure 5:
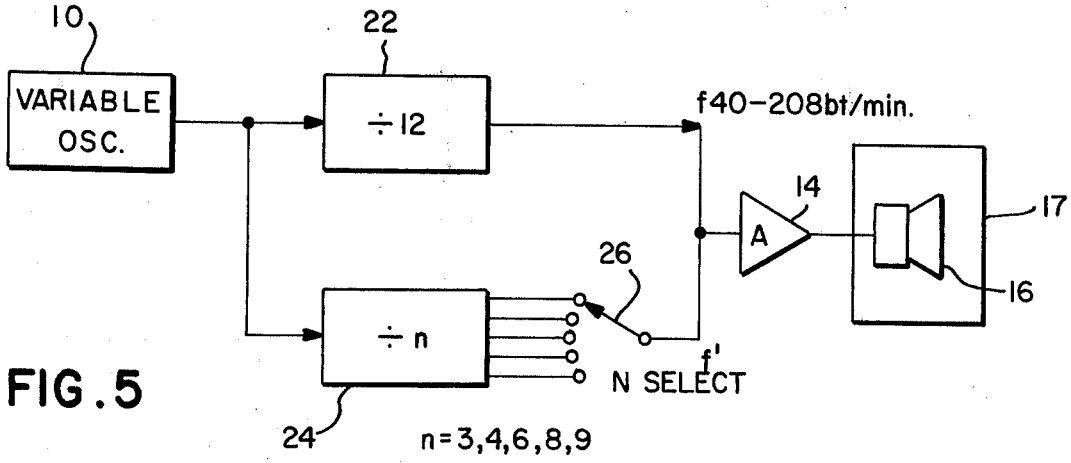
FIG. 5 is a block diagram of a further embodiment of the invention.

FIG. 5 shows an alternative embodiment of the metronome capable of providing cross rhythms wherein the cross rhythm ratios are fixed with respect to one another and are adjustable by a single linear adjustment and a switch. A linearly adjustable metronome circuit 10 of the type herein described provides an adjustable output over the range of approximately 480 beats per minute to 2500 beats per minute. The output of the metronome circuit 10 is provided simultaneously to a divide-by-12 counter 22 and to a divide-by-N counter 24. Counter 22 provides an output adjustable over the rate of approximately 40 beats per minute to 208 beats per minute. Switching means 26 associated with counter 24 in operation to select the value N, where N may be 3, 4, 6, 8 or 9. Each of the counters 22 and 24 provides an output having a different pulse rate. The outputs of counters 22 and 24 are mixed and provided to an amplifier 14, loudspeaker 16 and resonant enclosure 17 as hereinabove described. A metronome with audibly distinctive cross rhythms of ratios 2:1, 3:1, 4:1, 3:2 and 4:3 as well as other cross rhythm combinations may be provided as desired by the proper selection of the value N.

It will be appreciated that various implementations of the invention may occur to those versed in the art without departing from the spirit and true scope of the invention. Accordingly, it is not intended to limit the invention by what has been particularly shown and described except as indicated in the appended claims.

What is claimed is:

1. An electronic metronome comprising:

circuit means providing a plurality of pulses;

timing means in circuit association with said circuit means for controlling the rate of said pulses and including:

a linear potentiometer;

a compensation network for providing a non-linear sequence of pulse rates in response to uniform incremental adjustment of said linear potentiometer to provide a non-linear sequence of tempi calibrations according to Maelzel markings;

means for manual adjustment of said linear potentiometer; and output means operative in response to said pulses to provide an output indication of tempo.

2. An electronic metronome according to claim 1 wherein said output means includes a loudspeaker and a speaker housing resonantly coupled to said loudspeaker and wherein said circuit means provides said plurality of pulses of a form to resonantly drive said loudspeaker.

3. An electronic metronome according to claim 1 and further including:

second circuit means providing a plurality of pulses:

timing means in circuit association with said second circuit means for controlling the rate of said pulses and including:

a second linear potentiometer;

a second compensation network for providing a non-linear sequence of pulse rates in response to uniform incremental adjustment of said linear potentiometer; and means for coupling said first and second circuit means such that said second circuit means provides pulses at pulse rates which are selected subdivisions of said tempo selected by said first linear potentiometer.

4. An electronic metronome according to claim 3 wherein said second circuit means provides a plurality of pulses different from said plurality of pulses provided by said first circuit means and operative to produce audibly distinct sub-beats by said output means.

5. An electronic metronome according to claim 1 further including:

first divider means operative in response to pulses from said circuit means to provide first output pulses of a first pulse rate which is a predetermined fraction of the selected rate of said circuit means pulses;

second divider means including manual switching means for selection of different division factors and operative in response to said circuit means pulses to provide second output pulses of a rate determined by said switching means; and means for applying said first and second output pulses to said output means.

6. An electronic metronome comprising:

first circuit means providing a plurality of first pulses;

timing means in circuit association with said first circuit means for controlling the rate of said first pulses;

second circuit means providing a plurality of second pulses;

timing means in circuit association with said second circuit means for controlling the rate of said second pulses;

each of said timing means including:

a linear potentiometer;

a compensation network which in conjunction with said linear potentiometer provides a non-linear sequence of pulse rates in response to uniform incremental adjustment of said linear potentiometer to provide a non-linear sequence of tempi calibrations according to Maelzel markings; and means for manual adjustment of said linear potentiometer;

means for capacitively coupling said first and second circuit means to provide substantially synchronous circuit operation; and output means operative in response to said first and second pulses to provide an output indication of tempo as selected by said first linear potentiometer and selected subdivisions of said tempo as selected by said second linear potentiometer.

7. An electronic metronome according to claim 6 wherein said first and second circuit means each include an oscillator having an output pulse rate controllable according to the manual adjustment of the associated linear potentiometer.

8. An electronic metronome according to claim 7 wherein said output means includes a loudspeaker and a speaker housing resonantly coupled to said loudspeaker for providing an audible output indication of tempo.

9. An electronic metronome according to claim 8 wherein said first and second circuit means each provide output pulses of different duration thereby to produce audibly distinct beats and sub-beats by said loudspeaker.

* * * * *